US005797760A

United States Patent [19]

Swindlehurst

[11] Patent Number: 5,797,760

[45] Date of Patent: Aug. 25, 1998

[54] ELECTRICAL COMPONENTS AND APPARATUS

[75] Inventor: Neil Andrew Swindlehurst, Pershore, England

[73] Assignee: Smiths Industries PLC, London, England

[21] Appl. No.: 877,917

[22] Filed: Jun. 18, 1997

[30] Foreign Application Priority Data

Jul. 4, 1996 [GB] United Kingdom ..... 9614051

[51] Int. Cl.[6] ..... H01R 13/28

[52] U.S. Cl. ..... 439/289; 439/891

[58] Field of Search ..... 439/289, 700, 439/829, 737, 738, 709, 801, 721, 796, 797, 798, 891

[56] References Cited

U.S. PATENT DOCUMENTS

Re. 27,483 9/1972 Banning ..... 439/289

4,516,820 5/1985 Kuzma ..... 439/289

5,329,285 7/1994 Maros ..... 439/709

*Primary Examiner*—Neil Abrams

*Assistant Examiner*—T. C. Patel

*Attorney, Agent, or Firm*—Pollock, Vande Sande & Priddy

[57] ABSTRACT

An electrical contact has a metal housing with a threaded bore opening at one end into a circular well. A plated contact pad has a threaded stem screwed into the bore and a circular pad member recessed in the well. The pad member has several cut-outs around its edge, which are engageable by projections on a cooperating tool by which the contact can be inserted and removed from the housing. Contact to the housing is made by a conductor secured to the housing by means of a bolt inserted in the rear end of the bore.

11 Claims, 1 Drawing Sheet

ELECTRICAL COMPONENTS AND APPARATUS

BACKGROUND OF THE INVENTION

This invention relates to electrical components and apparatus including such components.

The invention is more particularly concerned with replaceable contact pad components and apparatus including such components.

Where electrical connection is made to replaceable devices, this may be by means of a butt contact, since connection is easily made and broken when the device is removed. The contacting faces are prone to damage as a result of misuse and, for this reason, it is necessary to replace the contacts regularly, which can be time consuming and expensive.

BRIEF SUMMARY OF THE INVENTION

It is an object of the present invention to provide an improved electrical contact component and apparatus including such a component.

According to one aspect of the present invention there is provided an electrical contact component comprising a contact housing of a conductive metal, the housing having an internally-threaded bore therein opening at one end into a circular well, and a contact pad of a conductive metal, the pad having an externally-threaded stem adapted to be screwed into the bore, the pad having a planar pad member adapted to be received in the well when the stem is screwed in the bore.

The forward surface of the pad member is preferably recessed within the well. The bore preferably opens at both ends of the housing, an electrical conductor being secured to the housing by means of a bolt inserted in the rear end of the bore. The pad member and the well are preferably of circular shape, the pad member having at least one peripheral cut-out engageable by projections on a cooperating tool by which the pad can be inserted and removed from the housing. The pad may be of metal and have a plated metal layer on at least the forward surface of the pad member. A part of the external surface of the housing may be non-circular to prevent rotation of the housing in a mounting hole. The housing may have an externally-projecting flange at its forward end.

According to another aspect of the present invention there is provided apparatus including at least one contact component according to the above one aspect of the present invention.

Apparatus including several contact components according to the present invention, will now be described, by way of example, with reference to the accompanying drawing.

DETAILED DESCRIPTION OF THE PREFERRED EMBODIMENT

Figure 1:
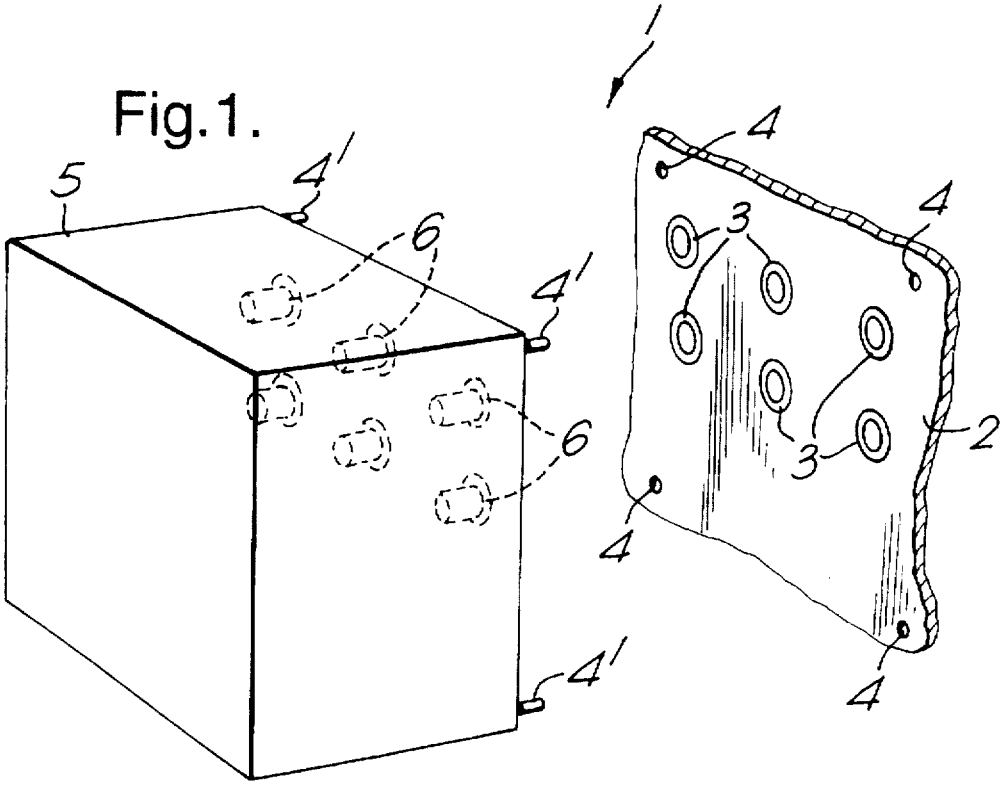
FIG. 1 is a perspective view of the apparatus.

With reference to FIG. 1, the apparatus 1 takes the form of an electrical power management system of which, only a part of the front panel 2 is shown. The front panel 2 supports two rows of three contacts 3 and four threaded apertures 4, which receive bolts 4' projecting from electrical equipment 5 so that the equipment can be retained on the panel. The equipment 5 has six contacts 6 positioned to mate with the contacts 3. The contacts 6 are conventional cylindrical metal studs with a diameter of 12 mm and with a flat end projecting a short distance from the front face of the equipment. The contacts 6 are spring loaded so that they resiliently engage the contacts 3.

Figure 2:
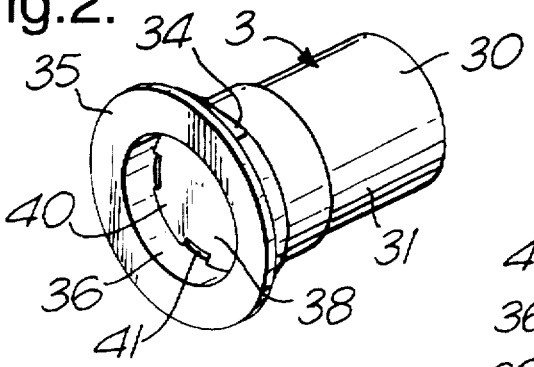
FIG. 2 is a perspective view of one of the contact components to a larger scale.
Figure 3:
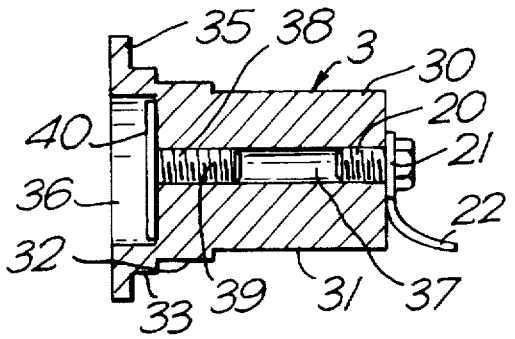
FIG. 3 is a cross-sectional side elevation of the contact component.
Figure 4:
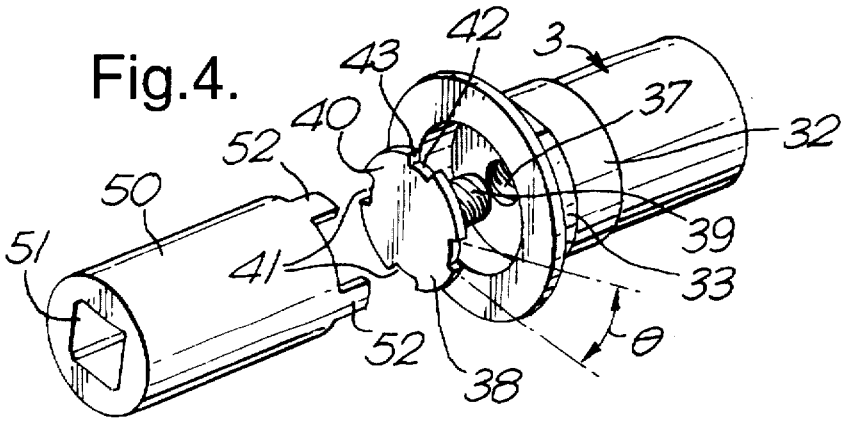
FIG. 4 is a perspective view of one of the contact components illustrating removal of the contact pad.

With reference now also to FIGS. 2 to 4, each contact 3 has a brass housing 30 of circular section and tubular shape. The rear part 31 of the housing 30 is about 13 mm in diameter. About two-thirds the way along its length, the housing has an intermediate portion 32 of diameter about 15 mm. The intermediate portion 32 is stepped out to form a short forward portion 33 with a diameter of about 17 mm, which is located in a mounting hole of the same size in the panel 2. One side of the forward portion 33 is flattened to form a flat 34, which locates with a similar formation in the mounting hole in the panel 2, to prevent rotation of the contact 3 in the mounting hole. The housing could be given other non-circular shapes to prevent rotation. The forward portion 33 also has a peripheral flange 35, of diameter about 24 mm, overlapping the edge of the hole in the panel 2. At its forward end, the housing 30 has a circular opening or well 36 with a diameter of 13 mm and a depth of about 5 mm. An axial bore 37, of a diameter of about 4 mm, extends through the housing 30, opening at both ends. The rear end of the bore 37 receives a bolt 20 by which a tag 21 at the end of an electrical power line or other conductor 22 can be electrically connected to the rear of the contact 3.

The contact 3 also includes a contact pad or button 38 machined from silver or some other metal having a high electrical conductivity. The pad has a solid cylindrical stem 39 about 6 mm long, which is externally threaded and has a diameter equal to that of the bore 37, so that the stem can be screwed into the bore. The pad 38 is completed by a circular, radially-projecting plate or pad member 40 about 12 mm in diameter and about 1.3 mm thick. The edge of the pad member 40 is interrupted by four notches 41 equally spaced around its circumference. The inner edge 42 of each notch 41 lies on a circle of diameter 10.5 mm, the sides 43 of each notch being formed by radii inclined at-an angle θ of 30°. The contact pad 38 has a protective, conductive coating provided by gold plating. When the contact pad 38 is screwed fully into the housing 30, the forward surface of the pad member 40 is recessed within the well 36.

The contact pad 38 can be removed from, or inserted into, the housing 30 using an insertion tool 50, as shown in FIG. 4. The insertion tool 50 is a cylindrical metal rod having a square recess 51 at one end shaped to receive the head of a conventional driver (not shown), such as of the kind used with socket spanners. The other end of the tool 50 has four longitudinally-projecting teeth 52 of arcuate shape, the size and position of which are such that the teeth can locate within the notches 41 in the contact pad 38, thereby enabling the tool to be used to remove or insert the contact pad.

When the equipment 5 is mounted on the panel 2, the contacts 6 project into the well 36 of each contact 3 and resiliently contact the front surface of the pad members 40. If the contacts 3 should become damaged as a result of misuse, or the like, the pads 38 are simply unscrewed from the housings, using the tool 50, and replaced with alternative pads.

What I claim is:

1. An assembly comprising a first electrical contact component and a second electrical contact component, said first electrical contact component comprising: a contact housing of a conductive metal, said housing having an internally-threaded bore therein and a well, said bore opening at one end into said well, and a contact pad of a conductive metal, said pad having an externally-threaded stem screwed into said bore, and said pad having a planar pad member received in said well, said second electrical contact component making abutting contact with said planar pad member of said first electrical contact component.

2. An assembly according to claim 1, wherein said planar pad member has a forward surface recessed within said well.

3. An assembly according to claim 1, wherein said bore opens at both ends of said housing, and wherein the first component includes an electrical conductor and a bolt inserted in a rear end of said bore, said bolt securing said conductor to said housing.

4. An assembly according to claim 1, wherein said planar pad member and said well are of circular shape.

5. An assembly according to claim 4, wherein said planar pad member has at least one peripheral cut-out engageable by projections on a cooperating tool by which said contact pad can be inserted into and removed from said housing.

6. An assembly according to claim 1, wherein said contact pad is of a metal and wherein said planar pad member has a plated metal layer on at least a forward surface thereof.

7. An assembly according to claim 1, wherein a part of an external surface of said housing is non-circular.

8. An assembly according to claim 1, wherein said housing has an externally-projecting flange at a forward end.

9. An assembly comprising electrical apparatus and cooperating equipment, said electrical apparatus including at least one first electrical contact component, said first contact component comprising: a contact housing of a conductive metal, said housing having an internally-threaded bore therein and a well, said bore opening at one end into said well, and a contact pad of a conductive metal, said pad having an externally-threaded stem screwed into said bore, and said pad having a planar pad member received in said well; said cooperating equipment including at least one second electrical contact component that makes abutting electrical contact with said planar pad member.

10. An assembly according to claim 9, including a plurality of said first contact components and a plurality of mounts by which said cooperating equipment can be secured with said apparatus, said cooperating equipment including a plurality of said second electrical contact components that make abutting electrical contact with respective ones of said first contact components.

11. An assembly comprising a first electrical contact component and a second electrical contact component, said first electrical contact component comprising: a contact housing fabricated of a conductive metal and having an internally-threaded bore opening at opposite ends of said housing, said housing having a circular well at one end of said housing, said bore opening into said well, a contact pad fabricated of a conductive metal and having an externally-threaded stem screwed into said bore, said contact pad having a circular planar pad member received in said well with a forward surface of said planar pad member recessed within said well; an electrical conductor; and a bolt inserted in a rear end of said bore and securing said electrical conductor to said housing; said second electrical contact component making abutting contact with said planar pad member of said first electrical contact component.

* * * * *